United States Patent [19]

Wilke et al.

[11] Patent Number: 4,627,468

[45] Date of Patent: Dec. 9, 1986

[54] HYDRAULIC CONTROL VALVE WITH MANUAL OVERRIDE

[75] Inventors: Raud A. Wilke, Brookfield; Michael Paik, Waukesha, both of Wis.

[73] Assignee: Husco International, Inc., Waukesha, Wis.

[21] Appl. No.: 771,291

[22] Filed: Aug. 30, 1985

[51] Int. Cl.[4] ..... F15B 13/043

[52] U.S. Cl. ..... 137/625.66; 74/491; 74/625; 137/625.64; 251/14

[58] Field of Search ..... 74/491, 625; 137/628.64, 625.66; 251/14

[56] References Cited

U.S. PATENT DOCUMENTS

| | | | |
|---|---|---|---|
| 3,434,390 | 3/1969 | Weiss | 137/625.64 X |
| 4,011,891 | 3/1977 | Knutson et al. | 137/625.64 X |
| 4,185,660 | 1/1980 | Faix | 137/625.64 |
| 4,240,304 | 12/1980 | Griffiths | 74/625 X |
| 4,285,496 | 8/1981 | Coles | 74/625 X |

*Primary Examiner*—Gerald A. Michalsky

*Attorney, Agent, or Firm*—Andrus, Sceales, Starke & Sawall

[57] ABSTRACT

A manual override handle assembly for the operation of a hydraulic control valve of the type having a movable spool includes a housing forming a hollow chamber in which a spool extension is slidably mounted. A handle assembly extends outwardly from the housing and is mounted for pivotal movement within the chamber. The handle is movable to an inoperable position wherein the handle is disassociated from the spool extension so that movement of the spool extension will not result in movement of the handle. The handle is further movable to an operable position wherein the handle engages the spool extension so that movement of the handle results in movement of the spool extension.

6 Claims, 7 Drawing Figures

HYDRAULIC CONTROL VALVE WITH MANUAL OVERRIDE

CROSS-REFERENCES TO RELATED PATENT APPLICATIONS

DESCRIPTION

1. Technical Field

This invention relates to a control handle assembly for the operation of a hydraulic control valve and more particularly to a manual override handle for control of a hydraulic valve when the remote controls for the valve become inoperative.

2. Background Art

| PATENT NO. | INVENTOR | ISSUE DATE |
|---|---|---|
| 1,364,578 | Nelson | 01-04-21 |
| 1,743,241 | Schmidt | 01-14-30 |
| 3,401,574 | Doolittle | 09-17-68 |
| 3,786,692 | Bjork | 01-22-74 |
| 4,008,626 | Schulte et al | 02-22-77 |
| 4,473,203 | Barnoin et al | 09-25-84 |

On certain machines such as "cherry pickers" in which a man-carrying basket is attached to the end of a telescoping and pivoting boom, the controls for the hydraulic valves which control the movement of the boom must be capable of being operated from more than one location. Typically, the telescoping and pivotal movement of the boom and the positioning of the basket is controlled by the man in the basket by means of electric switch instrumentalities which selectively govern the energization and de-energization of a pair of solenoids that effect actuation of the valve spool between two working and non-working positions. However, if a malfunction should occur or if the worker in the basket should become disabled, it is necessary that the control valves be capable of being manually operated from ground level.

Existing auxiliary control handles follow the movement of the hydraulic spool when the valve is remotely operated from the basket. This results in poor control characteristics due to the friction of the seals on the ground level handle mechanism as it follows the movement of the spool. It also creates a potential problem due to the fact that if an object such as a wrench or other tool gets caught between the auxiliary handle and the framework of the machine, the movement of the handle in the basket becomes ineffective.

The prior art patents listed above show a number of releasable controls in a variety of applications. However, none of these releasable controls is concerned with a control handle for the operation of a hydraulic control valve which is normally maintained in an inoperable position and which when brought into its operable position is automatically placed into a position corresponding to the position of the hydraulic control spool.

SUMMARY OF THE INVENTION

In accordance with one aspect of the invention, a manual override handle is mounted for pivoting motion on a plurality of axes fixed with respect to the housing of a control valve containing a movable valve spool, the handle being manually movable to and from a position at which it is operatively connected with the valve spool for actuation of the same between working and/or non-working positions.

In accordance with another aspect of the invention, the spool extension includes camming surfaces that automatically place the handle into a position corresponding to the position of the control valve spool when the handle is moved from its inoperative to its operative position.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figures 1, 2, 3:
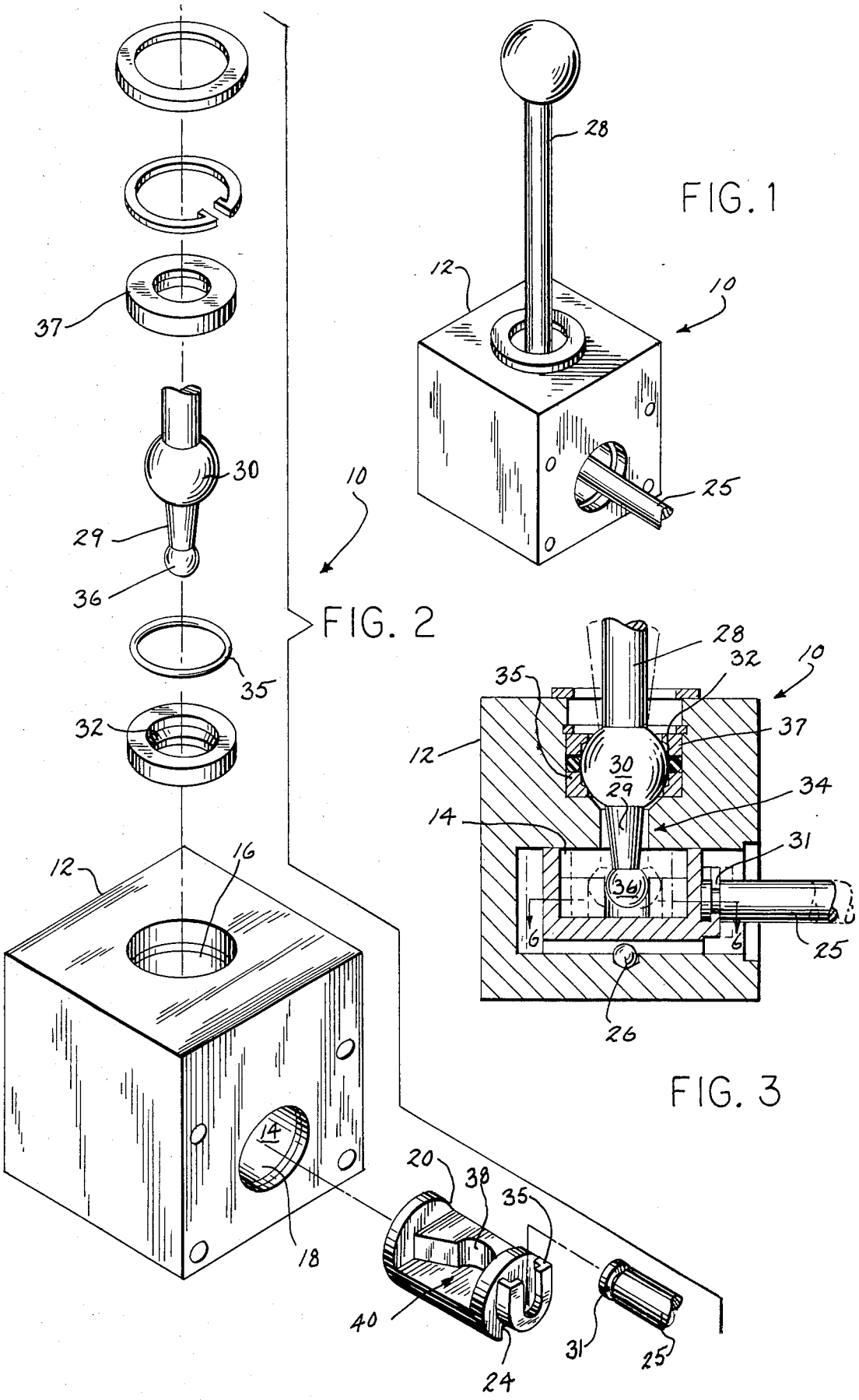
FIG. 1 is a perspective view of a manual override handle assembly constructed according to the invention.
FIG. 2 is an exploded perspective view of the manual override handle assembly of FIG. 1.
FIG. 3 is a side cross-sectional view of the manual override handle assembly of FIG. 1.
Figure 4:
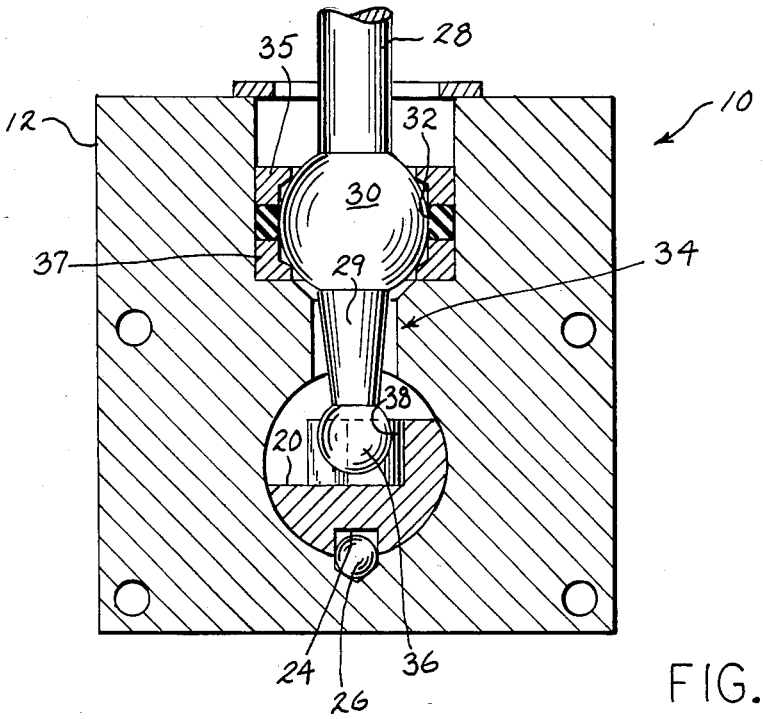
FIG. 4 is an end cross-sectional view of the handle assembly with the handle in an operative position.

A manual override handle assembly 10 includes a housing 12 defining a cylindrical chamber 14. Housing 12 is provided with sidewall openings 16 and 18 which allow cylindrical chamber 14 to communicate with the area outside of housing 12.

A spool extension 20 is axially slidably mounted within chamber 14. Spool extension 20 is provided with a notch 24 which registers with a detent ball 26 mounted in housing 12 so that rotational movement of spool extension 20 within cylindrical chamber 14 is prevented.

Figure 7:
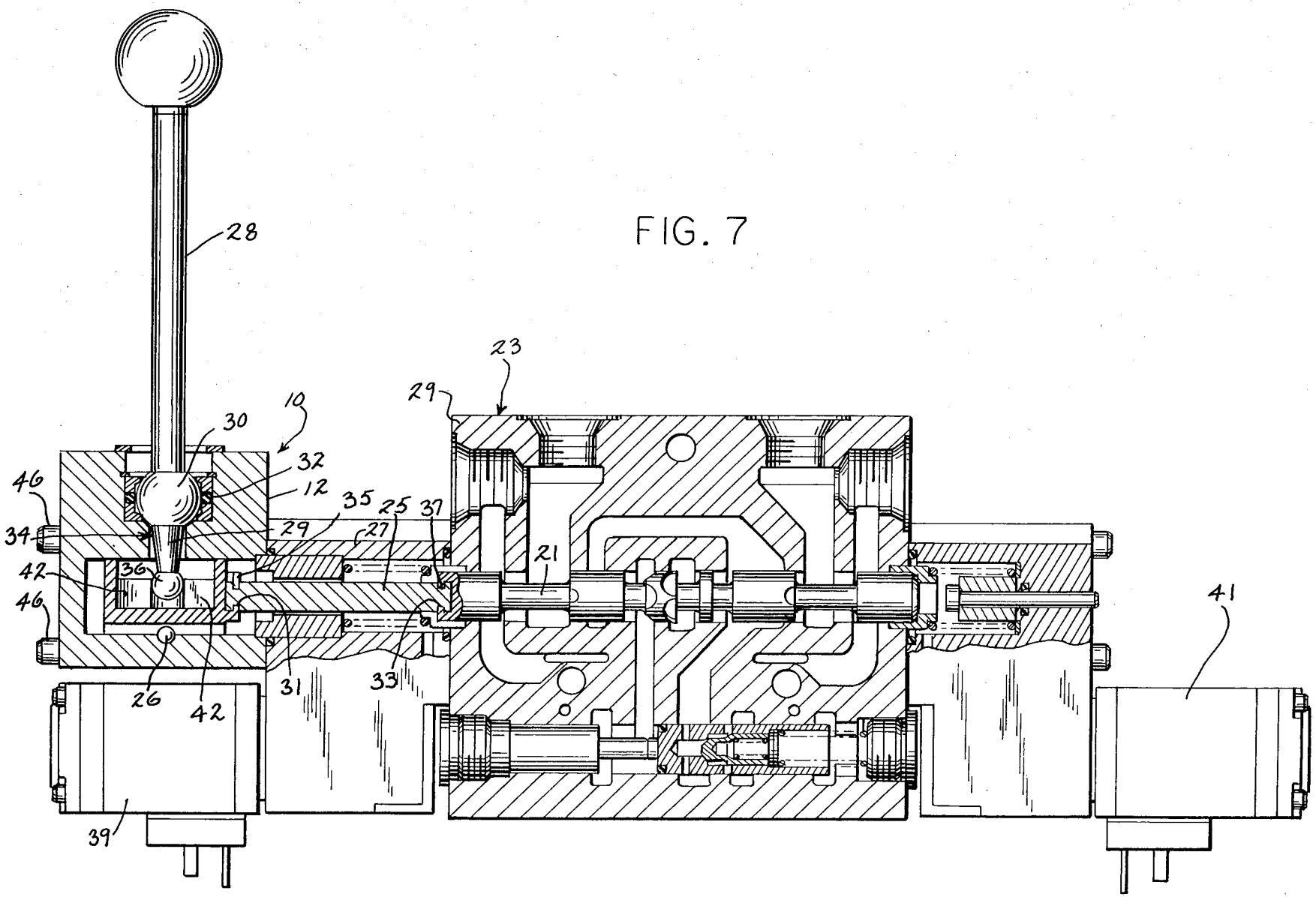
FIG. 7 is a side cross-sectional view of the handle assembly operatively connected to the control spool of a hydraulic valve.

As seen in FIG. 7 spool extension 20 is operably connected to movable spool 21 of hydraulic control valve 23 by means of spool connection 25 so that movement of spool 21 in hydraulic control valve 23 results in a corresponding movement of spool extension 20 into and out of cylindrical chamber 14.

Spool connection 25 is slideably mounted in an intermediate portion 27 and both housing 12 of handle assembly 10 and intermediate portion 27 are mounted on the end of housing 29 of hydraulic control valve 23 by means of through bolts 46. The ends of spool connection 25 include cirumferential notches 31 and 33 which are received by collars 35 and 37 located on spool extension 20 and control spool 21 respectively.

Handle assembly 10 is provided with a handle 28 that is pivotally mounted to housing 12 by means of ball 30 located at the lower end of handle 28 which rests in circular socket 32 of housing 12. The lower portion 34 of handle 28 provides a driver 29 that extends downwardly into chamber 14 and terminates in a ball 36 at its innermost end. Handle 28 is provided with appropriate seals 35 and 37 above and below the pivot point.

As seen in FIG. 2, spool extension 20 includes a circular socket 38 having a side opening 40. Socket 38 is dimensioned so as to accept ball 36 on the driver 29.

Figure 5:
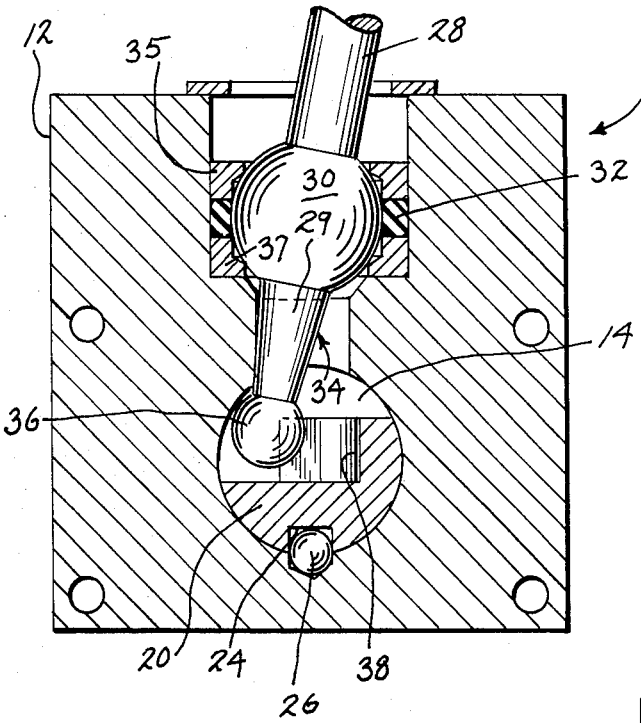
FIG. 5 is an end cross-sectional view of the handle assembly with the handle pivoted to an inoperative position.

As described above, handle assembly 10 is an auxiliary handle for operation of the hydraulic valve and it is desirable that when the handle is not in use, that it not follow the in and out movement of the valve spool and the corresponding in and out movement of spool extension 20. This is to say that the driver 29 does not resist axial movement of the spool extension 20 when driver 29 is in its inoperative position. Therefore, as shown in FIG. 5, handle portion 28 is normally maintained in an inoperative position by pivoting the handle along an axis parallel to the longitudinal axis of spool extension 20 so that ball 36 on driver 29 moves out of socket 38 and thus does not follow the in and out movement of spool extension 20.

Figure 6:
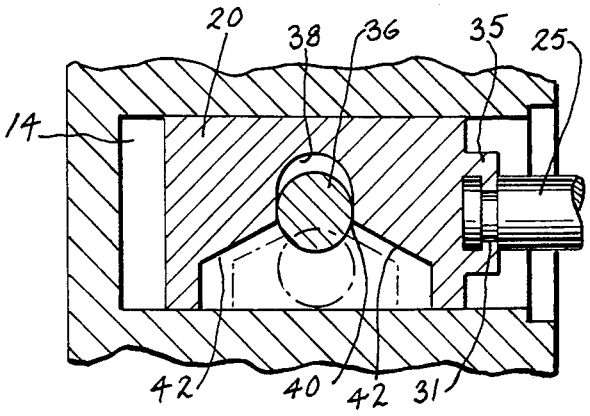
FIG. 6 is a sectional view of the handle assembly taken along line 6—6 of FIG. 3.

As seen in FIG. 2 and FIG. 6, spool extension 20 is provided with a pair of camming surfaces 42 which lead convergingly to socket 38. These surfaces are provided so that when spool extension 20 is at some position other than dead center, corresponding to the neutral position of valve spool, ball 36 can be guided into socket 38 by means of one or the other of the camming surfaces 42.

Normally, the movement of control spool 21 in hydraulic control valve 23 will be remotely controlled by means of electric switches (not shown) which selectively govern the energization and deenergization of solenoids 39 and 41 which in turn effect actuation of valve spool 21. When movement of control spool 21 is controlled remotely, handle 28 is pivoted to its inoperative position as described above and spool extension 20 is allowed to move axially in and out of chamber 14 as it follows the movement of hydraulic control spool 21. Should it become necessary to manually operate valve spool 21 by means of handle assembly 10, handle 28 is pivoted along an axis parallel to the longitudinal axis of extension 20 in order to bring ball 36 into position within socket 38. If spool extension 20 is in a withdrawn or extended position such as shown in phantom in FIG. 3, ball 36 will be engaged by one of the camming surfaces 42 and be slid into position within circular socket 38. As ball 36 slides along camming surface 42 handle 28 will pivot along an axis perpendicular to the longitudinal axis of spool extension 20 and thus handle 28 will assume an angular position such as shown in phantom in FIG. 3, that corresponds to the position of the control valve spool.

While the invention has been particularly shown and described with respect to a preferred embodiment thereof, it will be understood by those skilled in the art that the foregoing and other changes in form and details may be made therein without departing from the spirit and scope of the invention.

Having thus described my invention, what I claim as new, and desire to secure by Letters Patent is:

1. A hydraulic control valve of the type including housing means containing an axially movable valve spool and remotely controllable means which provide for actuation of the spool between working and non-working positions, characterized by manually operable means for shifting said spool, comprising:

a driver in the housing means, for actuating the spool;

means mounting the driver in the housing means adjacent to one end portion of the spool to provide for back and forth motion of the driver lengthwise of the spool axis and for motion of the driver crosswise of the spool axis between a neutral position at which the spool is movable relative to the driver and an operative position relative to the spool;

a handle operatively connected to the driver and projecting to the exterior of the housing means to provide for actuation of the driver crosswise of the spool axis as well as lengthwise of said axis;

and means for establishing a driving connection between the spool and driver effective upon handle produced motion of the driver to its operative position, whereby the spool can then be moved axially between working and non-working positions in consequence of handle produced actuation of the driver lengthwise of the spool axis.

2. The hydraulic control valve of claim 1 further characterized by cooperating means on the spool and driver effective upon handle produced motion of the driver toward the spool axis for guiding the driver into driving relation with the spool.

3. The hydraulic control valve of claim 2 wherein said cooperating means comprises a ball-shaped portion on the driver and a pair of opposing guide surfaces on the spool, which surfaces diverge outwardly of the spool axis to be spaced apart far enough to accommodate said ball-shaped portion therebetween while allowing for axial movement of the spool relative to the driver between working and non-working positions of the spool.

4. The hydraulic control valve of claim 3 wherein said spool comprises an attached coaxial spool extension cooperable with said driver; and wherein said housing means comprises a separate housing for said spool extension secured to the control valve housing and having the driver mounted therein.

5. The hydraulic control valve of claim 3 wherein the spool is provided with a socket toward which said guide surfaces converge and in which said ball-shaped portion on the driver is engaged to provide said driving connection.

6. A handle assembly for a remotely governed hydraulic control valve of the type including housing means containing an axially movable valve spool, in which the handle provides for override actuation of the spool, comprising:

a housing having means thereon to provide for securement of the assembly to the body of a hydraulic control valve with a bore in the housing co-axial with the spool of the valve;

an axially movable spool extension in said bore having means thereon to provide for co-axial securement of the extension to the spool of an associated hydraulic control valve to which the handle assembly is secured;

a handle movably mounted on the housing and having a driver for said extension projecting into said bore and shiftable to an operative position in consequence of handle produced motion of the driver crosswise of the axis of the extension toward said axis, from an inoperative position at which the extension is movable relative to the driver;

and cooperating means on the extension and the driver effective in the operative position of the driver to translate handle produced motion of the driver along a path lengthwise of the axis of the extension into axial movement of the extension and the spool of an associated hydraulic control valve.

* * * * *